US007427216B1

(12) United States Patent
Wu et al.

(10) Patent No.: US 7,427,216 B1
(45) Date of Patent: Sep. 23, 2008

(54) VEHICLE CHARGER

(75) Inventors: Hong-Shui Wu, Taipei Hsien (TW); Er-Mu Fan, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/868,303

(22) Filed: Oct. 5, 2007

(51) Int. Cl.
*H01R 25/00* (2006.01)

(52) U.S. Cl. ..... 439/638; 439/668

(58) Field of Classification Search ..... 439/76.1, 439/638, 639, 668, 700
See application file for complete search history.

(56) References Cited

U.S. PATENT DOCUMENTS 5,170,067 A * 12/1992 Baum et al. ..... 307/10.1
5,569,053 A * 10/1996 Nelson et al. ..... 439/668
6,612,875 B1 * 9/2003 Liao ..... 439/675
6,705,901 B1 * 3/2004 Lin ..... 439/668
6,752,649 B2 * 6/2004 Arkin et al. ..... 439/491
6,975,884 B2 * 12/2005 Seick et al. ..... 455/559
7,292,823 B2 * 11/2007 Kuo ..... 455/41.2
2007/0093279 A1 * 4/2007 Janik ..... 455/569.1
2007/0111700 A1 * 5/2007 Chen ..... 455/345

* cited by examiner

*Primary Examiner*—Thanh-Tam T. Le
(74) *Attorney, Agent, or Firm*—WPAT, P.C.; Anthony King

(57) ABSTRACT

A vehicle charger includes an insulating housing defining a connecting hole in a rear end thereof and receiving holes thereon. The connecting hole and the receiving holes communicate with the outside. A printed circuit board is fixedly received in the insulating housing. A positive assembly mounted in the insulating housing and electrically connecting with the printed circuit board has a pin passing through the connecting hole and stretching out of the insulating housing. A negative assembly assembled in the insulating housing and electrically connecting with the printed circuit board includes pressing buttons fabricated in the receiving holes respectively. The pressing button protrudes out of the receiving hole partially. A USB interface assembly and an earphone interface assembly are configured in the insulating housing and electrically connect with the printed circuit board respectively. The earphone interface assembly has an inclined end for mating with a chargeable plug of an earphone.

10 Claims, 6 Drawing Sheets

VEHICLE CHARGER

BACKGROUND OF THE INVENTION

1. Field of the Invention

The present invention relates to a charger, and more particularly to a vehicle charger adapted to being used in automobiles, aircrafts or the like for charging electronic devices.

2. The Related Art

Nowadays, varieties of electronic products are broadly used, such as mobile phones, MP3s, MP4s, etc. As the development of wireless communication technology, the electronic products are correspondingly equipped with bluetooth earphones. After the electronic products and the bluetooth earphones are used for a period of time, electric power of the electronic products and the bluetooth earphones is exhausted and the electronic products and the bluetooth earphones need to be charged. But when people travel by car or plane, it is hard to charge the electronic products and the bluetooth earphones. Therefore, vehicle chargers are provided on the market. The vehicle charger is capable of being inserted into a cigarette socket of the car or the plane to supply the electric power to the electronic product. However, if the user would like to charge a bluetooth device, such as an earphone, the user must have another charger. In this case, since the vehicle chargers are big, it is inconvenient to carry with.

SUMMARY OF THE INVENTION

Accordingly, an object of the present invention is to provide a vehicle charger used in automobiles, aircrafts or the like for charging electronic devices. The vehicle charger includes an insulating housing which defines a connecting hole in a rear end thereof and receiving holes thereon. The connecting hole and the receiving holes communicate with the outside. A printed circuit board is fixedly received in the insulating housing. A positive assembly that is mounted in the insulating housing and electrically connects with the printed circuit board has a pin that passes through the connecting hole and stretches out of the insulating housing. A negative assembly assembled in the insulating housing and electrically connecting with the printed circuit board includes pressing buttons fabricated in the receiving holes respectively. The pressing button protrudes out of the receiving hole partially. A USB interface assembly and an earphone interface assembly are respectively configured in the insulating housing and electrically connect with the printed circuit board. The earphone interface assembly has an inclined end for mating with a chargeable plug of an earphone.

As described above, the design of the present invention integrates the printed circuit board, the positive assembly, the negative assembly, the USB interface assembly and the earphone interface assembly in the insulating housing, therefore, reducing the dimension of the vehicle charger and with no cable exposed. So the vehicle charger is enough compact to conveniently carry with. More over, the vehicle charger not only chargers the electronic devices with a USB interface, but also chargers the earphones with the chargeable plug.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
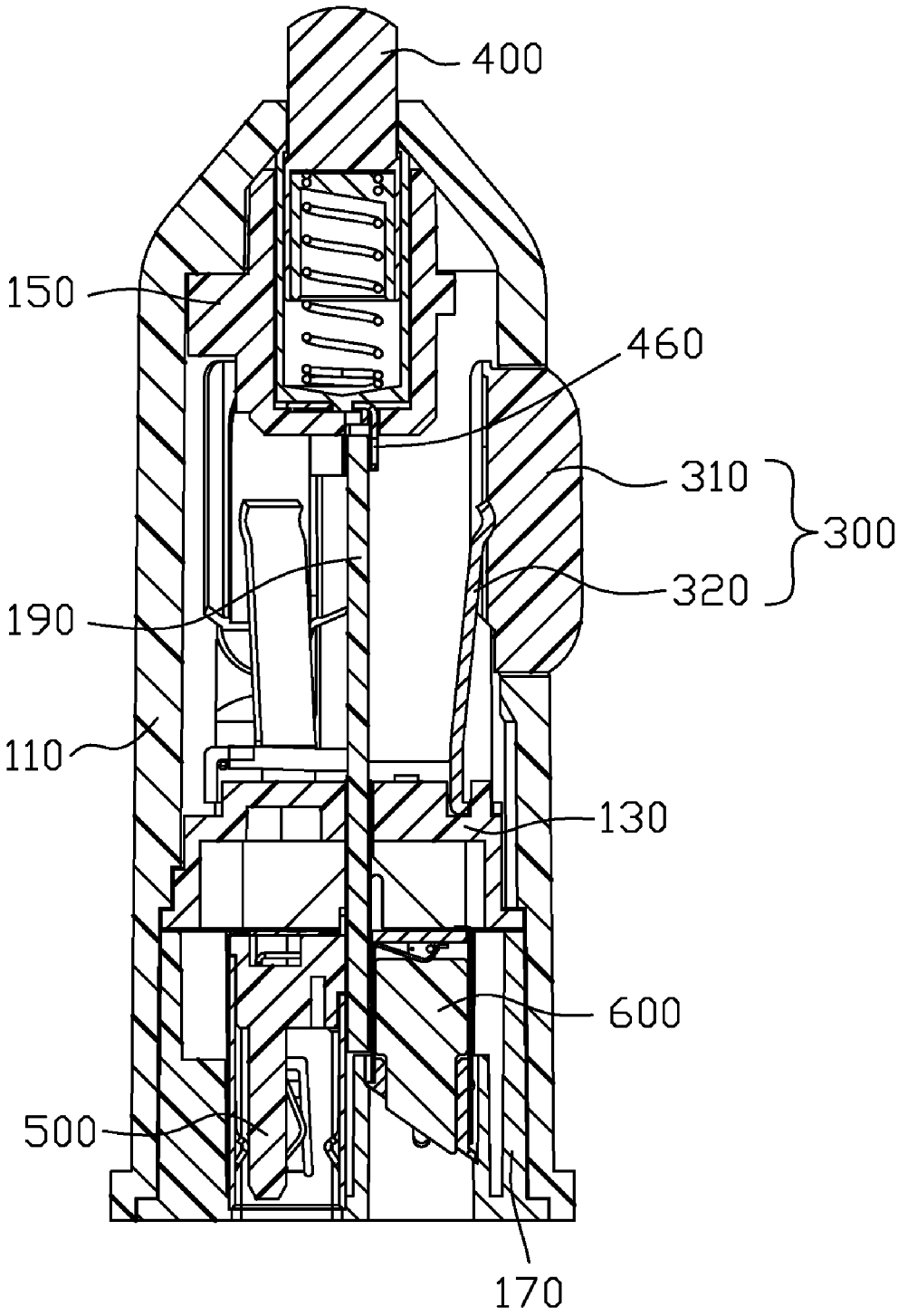
FIG. 1 is a cross-sectional view of a vehicle charger of the present invention.
Figure 2:
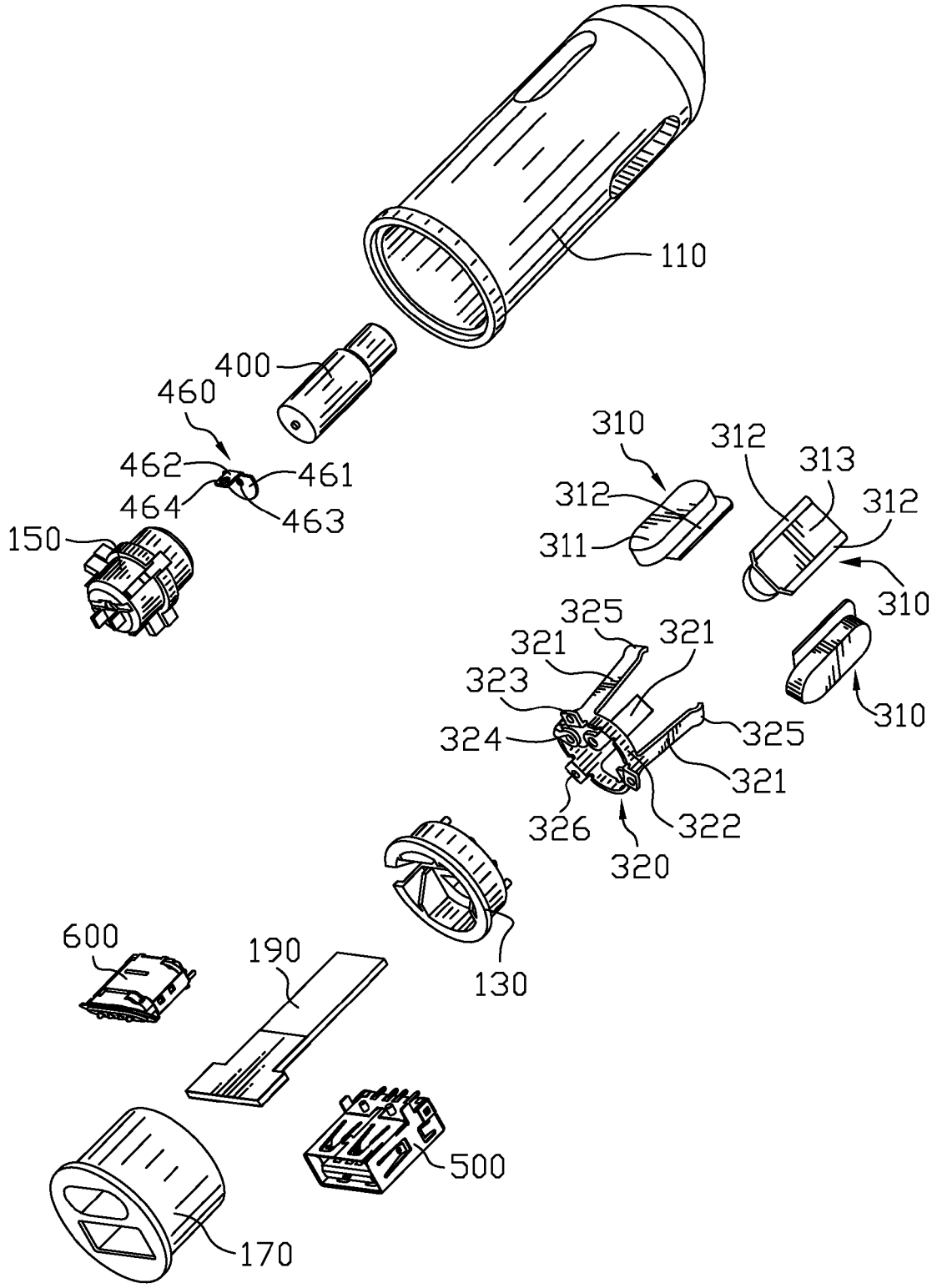
FIG. 2 is an exploded view of the vehicle charger.

Referring to FIG. 1 and FIG. 2, a vehicle charger in accordance with the present invention includes an insulating housing 110. The insulating housing 110 receives a frame 130, a back shell 150 and a front shell 170. The frame 130 holds a printed circuit board 190 and is fixed with a negative assembly 300 that electrically connects with the printed circuit board 190. The back shell 150 accepts a positive assembly 400 electrically connecting with the printed circuit board 190 through a connecting slice 460. The front shell 170 accommodates a USB interface assembly 500 and a bluetooth earphone interface assembly 600, both of which electrically connect with the printed circuit board 190.

Figure 3:
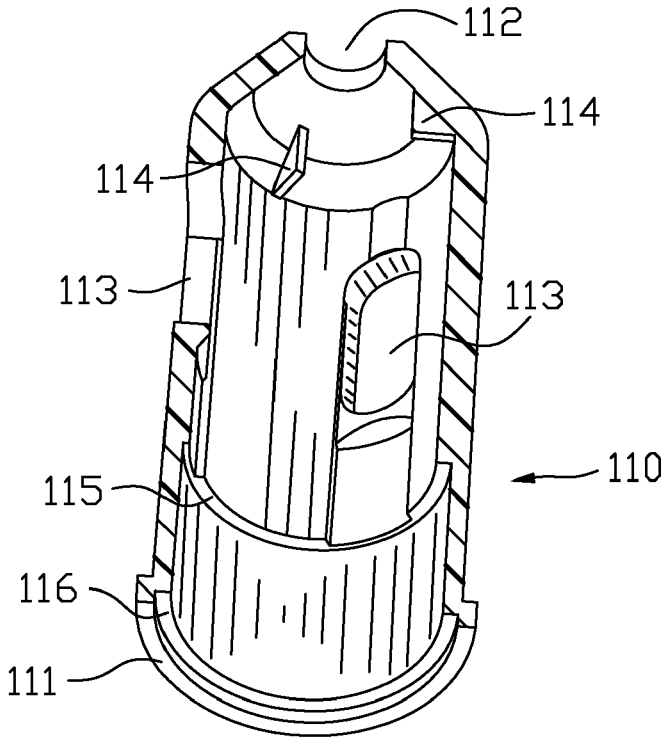
FIG. 3 is a cross-sectional view of an insulating housing of the vehicle charger.

With reference to FIG. 3, the insulating housing 110 is in a substantially hollow cylindrical shape. A rear end of the insulating housing 110 extends backward and becomes more and more narrow, forming a taper shape. A connecting hole 112 that communicates with the outside is defined longitudinally in the rear end of the insulating housing 110. An inner surface of the insulating housing 110 protrudes inward to form three locking sheets 114 which are distributed symmetrically and near the rear end of the insulating housing 110. The insulating housing 110 defines longitudinally three receiving holes 113 at substantial center. The three receiving holes 113 communicate with the outside and are distributed symmetrically. The insulating housing 110 is cut toward the body thereof and forms a first step portion 115 in front of the receiving holes 113. A front end of the insulating housing 110 is open. An outer edge of a front surface of the front end protrudes outward to form a circular projection 111, and then, a second step portion 116 is formed at the front end of the insulating housing 110.

Figure 4:
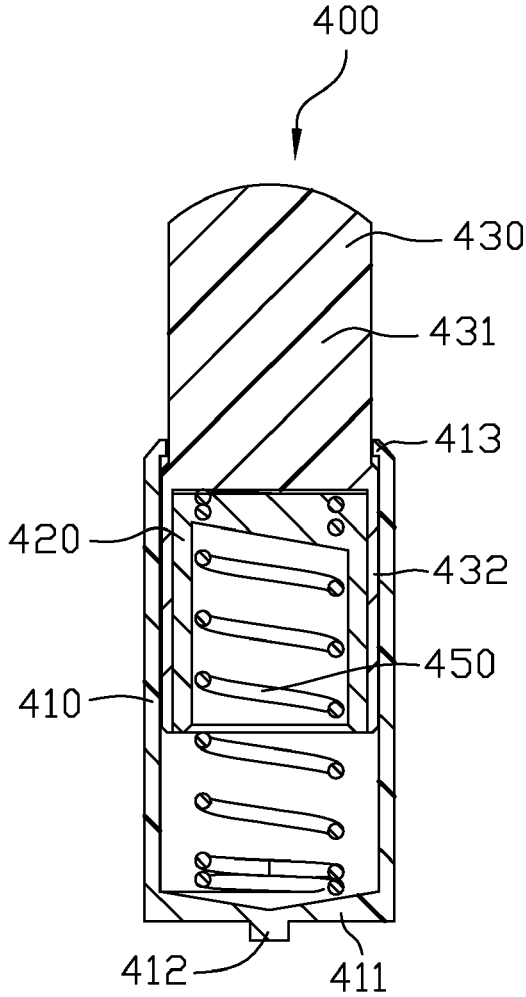
FIG. 4 is a cross-sectional view of a positive assembly of the vehicle charger.

Please refer to FIG. 1, FIG. 2 and FIG. 4. The positive assembly 400 includes a cylindrical hollow sleeve 410. The sleeve 410 has a front wall 411 which seals a front end of the sleeve 410. A front surface of the front wall 411 projects forward and forms a column pillar 412 below the center thereof. A back end of the sleeve 410 is open and shrinks inward a bit to form an inserting mouth 413. The sleeve 410 receives a connecting member 430. A rear end of the connecting member 430 defines a column-shaped pin 431 that extends out of the sleeve 410 from the inserting mouth 413. A front end of the connecting member 430 defines a hollow cylinder 432 that is accommodated in the sleeve 410. A radius of the cylinder 432 is a bit greater than a radius of the inserting mouth 413. The cylinder 432 accepts a hollow can 420 therein. The hollow can 420 has an open front end. A helix spring 450 is received in the hollow can 420. One end of the helix spring 450 is against an back end of the hollow can 420 and an opposite end of the helix spring 450 is against a back surface of the front wall 411 of the sleeve 410.

Figure 5:
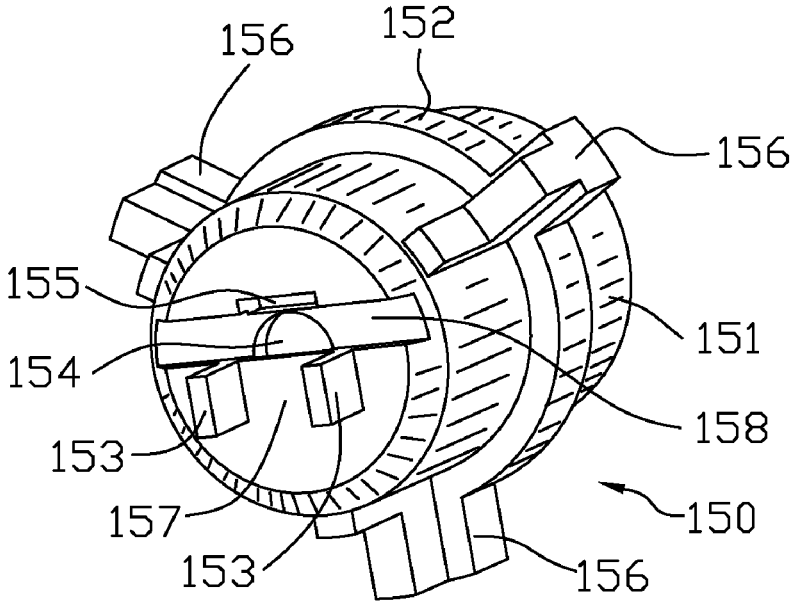
FIG. 5 is a perspective view of a back shell for receiving the positive assembly of the vehicle charger.
Figure 6:
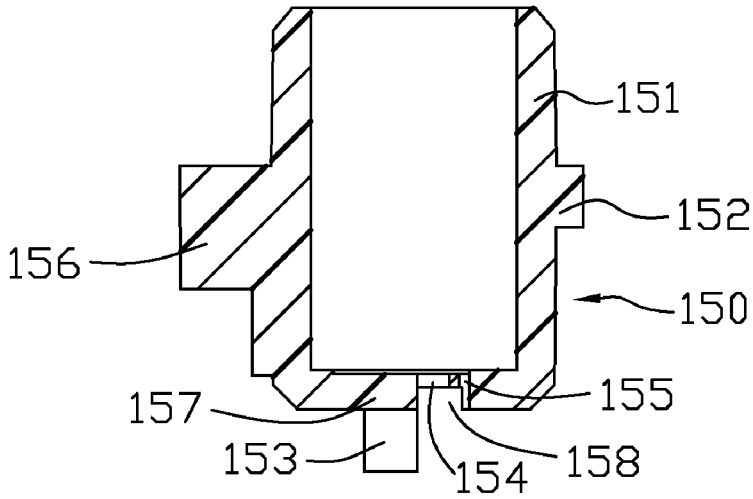
FIG. 6 is a cross-sectional view of the back shell.

Referring to FIGS. 5-6, the back shell 150 for receiving the positive assembly 400 has a substantially cylindrical hollow body 151 whose back end is open. The hollow body 151 has a front block 157 which seals a front end thereof. A groove 158 is defined at substantial the center of the front block 157. A semicircular through-hole 154 is defined at the middle of the groove 158. The front block 157 defines a slot 155 above the groove 158 and further above the semicircular through-hole 154. Two patches 153 extend forward from the front block 157. The two patches 153 are disposed under the groove 158 and distributed at bilateral sides of the semicircular through-hole 154. The hollow body 151 protrudes outward at center to form a circular protrusion 152. Three step-shaped supporting blocks 156 are defined from the front end to the protrusion 152 and distributed symmetrically around the hollow body 151.

With reference to FIG. 2 as well as FIG. 4, the connecting slice 460 is provided to electrically connect the positive assembly 400 with the printed circuit board 190. The connecting slice 460 has a base portion 461 that defines a mating hole 463 passing therethrough. The base portion 461 is attached to the front surface of the front wall 411 of the sleeve 410. The mating hole 463 accepts the column pillar 412 therein. The top of the base portion 461 extends forward and forms a linking portion 462. A locating hole 464 is defined on the linking portion 462.

Figure 7:
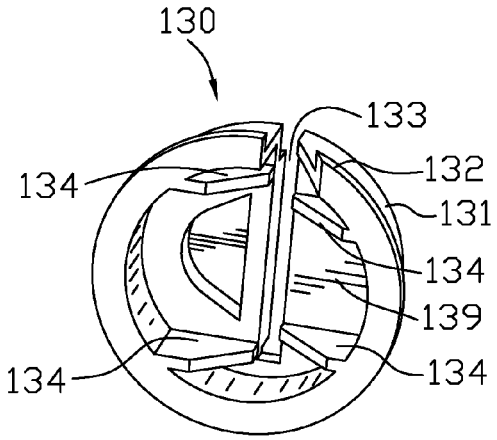
FIG. 7 is a perspective view of a frame of the vehicle charger.
Figure 8:
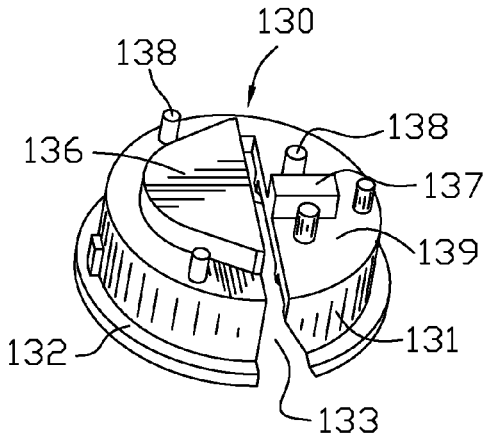
FIG. 8 is another perspective view of the frame of the vehicle charger.

Referring to FIGS. 7-8 as well as FIG. 2, the frame 130 that is in a basin shape has a bottom wall 139, an enclosure 131 extending from the bottom wall 139 and a wing member 132 protruding outward and formed at the front of the enclosure 131. The bottom wall 139 defines a gap 133 passing therethrough. The gap 133 passes through one side of the enclosure 131 and the wing member 132. Four fastening blocks 134 protrude from an inner surface of the enclosure 131. Every two fastening blocks 134 faces to each other. A back surface of the bottom wall 139 defines five columns 138. Thereinto, three of the columns 138 are arranged at one side of the gap 133 and the other two columns 138 are arranged at the other side of the gap 133. A rectangular locking block 137 protrudes from the back surface of the bottom wall 139 and is disposed among the three columns 138. A substantially inverted triangle-shaped limiting block 136 protrudes from the back surface of the bottom wall 139 and is disposed between the two columns 138.

Please refer to FIG. 1 and FIG. 2. The negative assembly 300 that is fixed with the frame 130 includes three pressing buttons 310 and a negative member 320. The pressing button 310 has an oval-shaped press-fitting section 311 that is disposed longitudinally. The bottom of the press-fitting section 311 is a bit hollow and forms a recess 313. Bilateral sides of the bottom of the press-fitting section 311 extend outward to form two contacting sections 312. The negative member 320 has a ring portion 322. Three long sheet-shaped elastic arms 321 extend from the bottom of the ring portion 322. The three elastic arms 321 are disposed symmetrically. A rear end of the elastic arm 321 protrudes a bit to form a restraining portion 325. The front of the ring portion 322 extends forward and then bends perpendicularly outward to form three first fixing sheets 323. The front of the ring portion 322 extends forward and then bends perpendicularly inward to form two second fixing sheets 324. The first fixing sheets 323 and the second fixing sheets 324 respectively define an aperture 326 passing therethrough.

Figure 9:
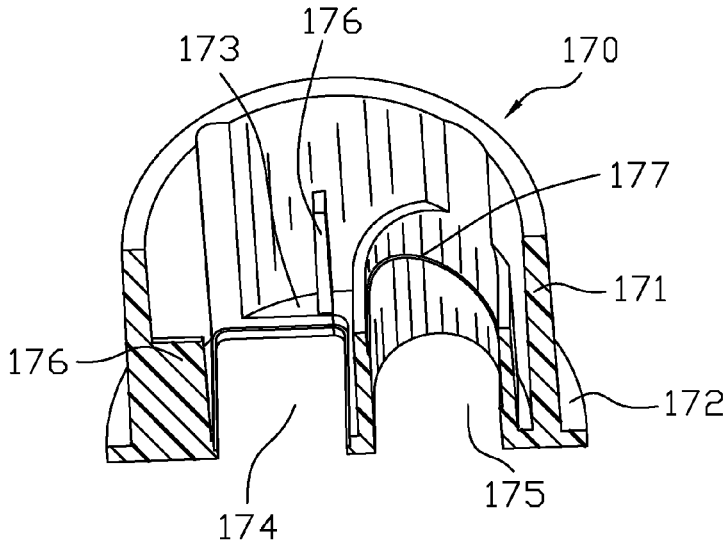
FIG. 9 is a cross-sectional view of a front shell of the vehicle charger.

Please refer to FIG. 1, FIG. 2 and FIG. 9. The front shell 170 has a front section 173 which extends backward to form a column-shaped periphery wall 171. A front surface of the front section 173 extends outward around thereof to define a locking rim 172. A USB interface cavity 174 and a bluetooth earphone interface cavity 175 are defined in a stacked array in the front shell 170 and pass through the front shell 170 longitudinally from the front section 173. The USB interface cavity 174 is rectangular. Three positioning blocks 176 protrude from a bottom surface of the front section 173. The three positioning blocks 176 are arranged at the front, the back and the left of the USB interface cavity 174. The bluetooth earphone interface cavity 175 is oval-shaped. An inner surface of the bluetooth earphone interface cavity 175 defines an arc-shaped positioning step 177 therein.

Figure 10:
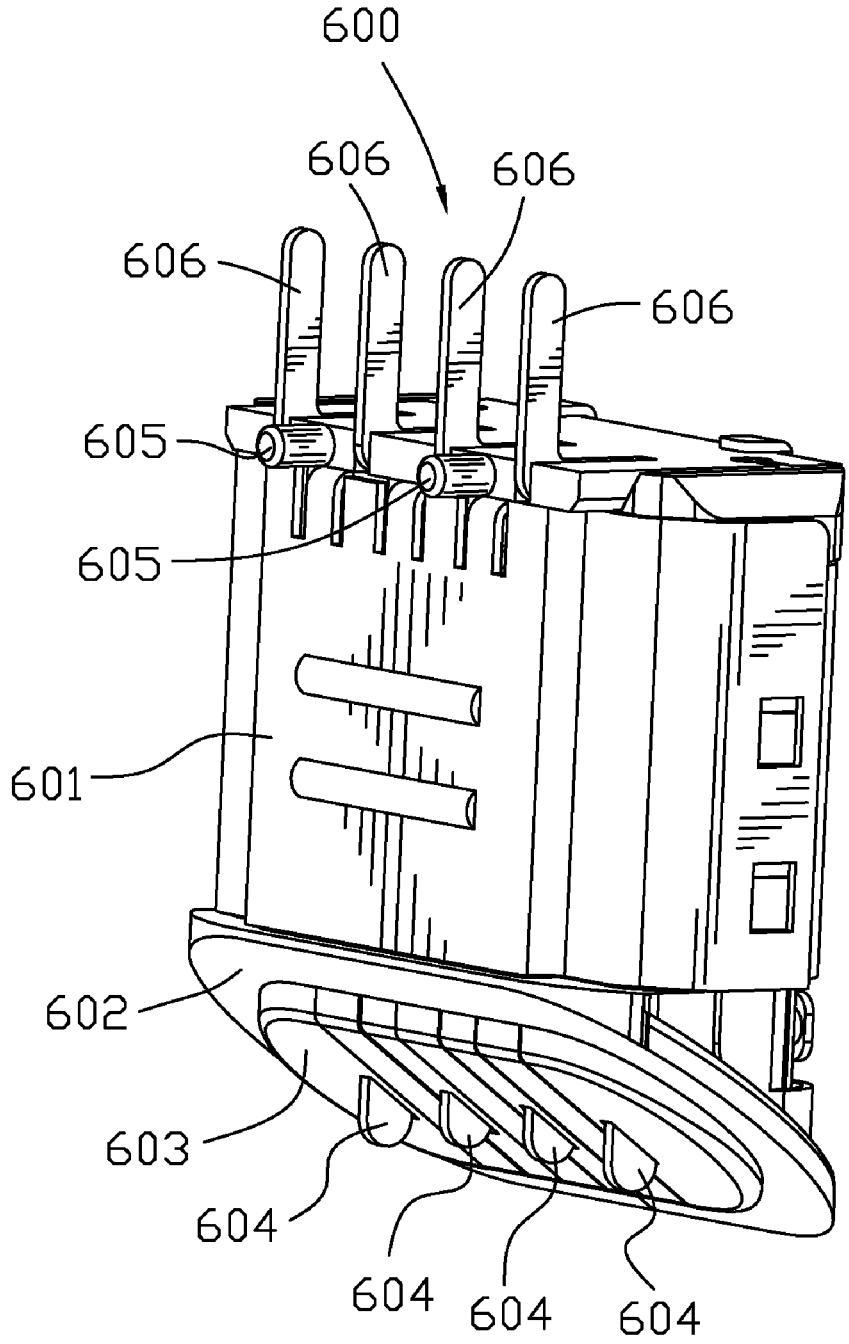
FIG. 10 is a perspective view of a bluetooth earphone interface assembly of the vehicle charger.

Please refer to FIG. 2 and FIG. 10. The bluetooth earphone interface assembly 600 includes a rectangular body 601 disposed longitudinally. The front of the rectangular body 601 connects with a substantially rectangular panel board 602 whose four corners are smoothly arc-shaped. The panel board 602 bevels relatively to the front of the rectangular body 601. A pitch angle defined between the panel board 602 and the rectangular body 601 is about 45 degrees. The panel board 602 protrudes forward at center to define a touching portion 603 which has the same structure as the panel board 602. Four touching terminals 604 are received in the touching portion 603 in a row and exposed out of the touching portion 603 partly for electrically connecting with a bluetooth earphone. Two connecting pillars 605 are defined at the rear of the bottom of the rectangular body 601 for being fastened on the printed circuit board 190. Four connecting terminals 606 are inserted in the rear of the rectangular body 601 in a row to electrically connect with the printed circuit board 190.

Referring to FIGS. 1-2, in assembly, the positive assembly 400 and the connecting slice 460 are received in the back shell 150. The linking portion 462 of the connecting slice 460 is inserted in the slot 155 of the back shell 150. Then, the back shell 150 is fabricated in the rear end of the insulating housing 110. The circular protrusion 152 is located in the space surrounded by the three locking sheets 114. The three supporting blocks 156 restrain against the inner surface of the insulating housing 110. The column-shaped pin 431 of the positive assembly 400 received in the back shell 150 stretches out of the insulating housing 110 through the connecting hole 112. The frame 130 and the negative assembly 300 are mounted in the insulating housing 110 before the back shell 150. The wing member 132 mates with the first step portion 115. The columns 138 of the frame 130 are inserted in the apertures 326 of the negative member 320 respectively to fixedly integrate the frame 130 with the negative member 320. The restraining portions 325 are against the recesses 313 of the pressing buttons 310 disposed in the receiving holes 113 of the insulating housing 110 respectively. The press-fitting section 311 is exposed of the receiving hole 113 and the contacting sections 312 are attached to the inner surface of the insulating housing 110. The printed circuit board 190 passes through the gap 133 defined on the frame 130 and the negative member 320 in turn. Then the printed circuit board 190 electrically connects with the negative member 320. A rear end of the printed circuit board 190 is received in the groove 158 and supported by the two patches 153 of the back shell 150. The rear end of the printed circuit board 190 is fixed with the linking portion 462 through the locating hole 464 of the connecting slice 460. A front end of the printed circuit board 190 is accommodated in the front shell 170. The front shell 170 is assembled in the insulating housing 110 with the locking rim 172 engaging with the second step portion 116. The USB interface assembly 500 and the bluetooth earphone interface assembly 600 are fittingly received in the USB interface cavity 174 and the bluetooth earphone interface cavity 175 respectively. Both of the USB interface assembly 500 and the bluetooth earphone interface assembly 600 electrically connect with the printed circuit board 190.

In use, the column-shaped pin 431 of the vehicle charger is inserted in a corresponding socket of a vehicle. Then, an electronic device with a USB interface and a bluetooth earphone with a chargeable plug are correspondingly inserted in the USB interface cavity 174 and the bluetooth earphone interface cavity 175 to electrically connect with the USB interface assembly 500 and the bluetooth earphone interface assembly 600. Then, the vehicle charger provides electric power to the electronic device and the bluetooth earphone.

As described above, the insulating housing 110 receives all other elements of the vehicle charger, therefore, reducing the dimension of the vehicle charger and with no cable exposed. So the vehicle charger is enough compact to conveniently carry with. More over, the vehicle charger not only chargers the electronic device with the USB interface, but also chargers the bluetooth earphone with the chargeable plug.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A vehicle charger, comprising:

an insulating housing, defining a connecting hole in a rear end thereof and receiving holes thereon, the connecting hole and the receiving holes communicating with the outside;

a printed circuit board, fixedly received in the insulating housing;

a positive assembly, mounted in the insulating housing and electrically connecting with the printed circuit board, having a pin which passes through the connecting hole and stretches out of the insulating housing;

a negative assembly, assembled in the insulating housing and electrically connecting with the printed circuit board, including pressing buttons fabricated in the receiving holes respectively, the pressing button protruding out of the receiving hole partially;

a USB (Universal Serial Bus) interface assembly, configured in the insulating housing and electrically connecting with the printed circuit board; and an earphone interface assembly, configured in the insulating housing and electrically connecting with the printed circuit board, having an inclined end for mating with a chargeable plug of an earphone, wherein the insulating housing further receives a frame, a back shell and a front shell, the frame holds the printed circuit board and is fixed with the negative assembly, the back shell accepts the positive assembly, the front shell accommodates the USB (Universal Serial Bus) interface assembly and the earphone interface assembly.

2. The vehicle charger as claimed in claim 1, wherein the inclined end has a pitch angle of 45 degrees.

3. The vehicle charger as claimed in claim 1, wherein the earphone interface assembly mates with a chargeable plug of a bluetooth earphone.

4. The vehicle charger as claimed in claim 1, wherein the frame that is in a basin shape has a bottom wall, an enclosure extending from the bottom wall and a wing member protruding outward and formed at the front of the enclosure, the bottom wall defines a gap passing therethrough, the gap further passes through one side of the enclosure and the wing member, wherein the printed circuit board runs through the frame from the gap.

5. The vehicle charger as claimed in claim 1, wherein the front shell defines a USB (Universal Serial Bus) interface cavity and an earphone interface cavity in a stacked array passing therethrough, the USB (Universal Serial Bus) interface assembly and the earphone interface assembly are received in the USB (Universal Serial Bus) interface cavity and the earphone interface cavity respectively.

6. The vehicle charger as claimed in claim 5, wherein the printed circuit board is disposed between the USB (Universal Serial Bus) interface cavity and the earphone interface cavity and electrically connects with the USB (Universal Serial Bus) interface assembly and the earphone interface assembly respectively.

7. The vehicle charger as claimed in claim 5, wherein the front shell has a front section which extends backward to form a periphery wall, three positioning blocks protrude from a bottom surface of the front section and around the USB (Universal Serial Bus) interface cavity, the USB (Universal Serial Bus) interface assembly is received in the USB (Universal Serial Bus) interface cavity and locked by the three positioning blocks.

8. The vehicle charger as claimed in claim 1, wherein the negative assembly includes the pressing buttons received in the receiving holes of the insulating housing respectively and a negative member which is fastened with the frame and electrically connects with the printed circuit board, the pressing button has a press-fitting section, the bottom of the press-fitting section is a bit hollow and forms a recess, bilateral sides of the bottom of the press-fitting section extend outward to form two contacting sections, the negative member has a ring portion, long elastic arms extend from the bottom of the ring portion, a rear end of the elastic arm protrudes a bit to form a restraining portion, the restraining portion is received in the recess and resists the pressing button to make the press-fitting section protrude out of the receiving hole of the insulating housing.

9. The vehicle charger as claimed in claim 1, wherein the insulating housing is in a substantially hollow cylindrical shape, the rear end of the insulating housing extends backward and becomes more and more narrow, forming a taper shape, a front end of the insulating housing is open, an outer edge of a front surface of the front end protrudes outward to form a circular projection.

10. The vehicle charger as claimed in claim 1, wherein the insulating housing defines three said receiving holes thereon and the three receiving holes are distributed symmetrically around the insulating housing, correspondingly, the number of the pressing buttons is three.

* * * * *